US007591319B2

(12) United States Patent
Xu

(10) Patent No.: US 7,591,319 B2
(45) Date of Patent: Sep. 22, 2009

(54) GAS ACTIVATED ACTUATOR DEVICE FOR DOWNHOLE TOOLS

(75) Inventor: Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 310 days.

(21) Appl. No.: 11/522,693

(22) Filed: Sep. 18, 2006

(65) Prior Publication Data

US 2008/0066931 A1 Mar. 20, 2008

(51) Int. Cl.
*E21B 23/00* (2006.01)

(52) U.S. Cl. ..... 166/381; 166/63; 166/319; 166/325; 166/321

(58) Field of Classification Search ..... 166/63, 166/381, 383, 319, 325, 321
See application file for complete search history.

(56) References Cited

U.S. PATENT DOCUMENTS 2,701,614 A * 2/1955 Ragan et. al. ..... 166/63
6,382,234 B1 5/2002 Birckhead et al.

OTHER PUBLICATIONS

TAFA Incorporated, Application Data, TAFA Series 300-301 Dissolvable Metal, 1989, pp. 1-3, TAFA Incorporated, Concord, New Hampshire, USA.

* cited by examiner

*Primary Examiner*—David J Bagnell
*Assistant Examiner*—Sean D Andrish
(74) *Attorney, Agent, or Firm*—Greenberg Traurig LLP; Anthony F. Matheny

(57) ABSTRACT

An actuator device for setting a downhole tool is disclosed. The actuator device includes a gas releasing material that releases a gas when activated by a solvent or other activator. The gas produced due to the contact with the activator is captured within a chamber in the downhole tool. As a result, gas pressure builds up inside the tool to move a piston and cause setting of the downhole tool.

18 Claims, 3 Drawing Sheets

GAS ACTIVATED ACTUATOR DEVICE FOR DOWNHOLE TOOLS

BACKGROUND

1. Field of Invention

The invention is directed to actuator devices for actuating downhole tools and, in particular, actuator devices having a material releases a gas that builds up sufficient pressure to facilitate activation of the actuator device and, thus, actuation of the downhole tool.

2. Description of Art

Some downhole tools need to be retained in an unset position until properly placed in the well. It is only when they are properly located within the well that the downhole tool is set through actuation of the tool. One prior technique for actuating the downhole tool is to open a window or passageway within the downhole tool exposing the actuating member, e.g., piston, of the downhole tool to the wellbore environment, e.g., the hydrostatic wellbore pressure. The hydrostatic pressure then acts upon the actuating member of the downhole tool and the downhole tool is actuated. In this technique, the creation of the window or passageway does not directly actuate the downhole tool. Instead, the creation of the window or passageway allows a different actuating mechanism, e.g., the hydrostatic or wellbore pressure, to actuate the tool. Additionally, in some instances, hydrostatic pressure is insufficient to actuate the tool.

In other prior attempts, pressures from fluids pumped down the well are used to break shear pins on the downhole tools. The use of shear pins, however, requires elevated directional pressure forces acting on the shear pins. However, in some instances sufficient pressure may not be available. Alternatively, in some wells, pressure, even if available, cannot be utilized because additional intervention steps are required which results in the well experiencing undesirable "downtime" for the additional intervention steps. Additionally, in some instances, the shear pins fail to shear when they are supposed to, causing further delays.

In still another prior technique, an explosive charge is included as part of the downhole tool. The explosive charge is then detonated by a detonator connected to the surface of the well through an electronic line or connected to battery pack located on the downhole tool. The force from the combustion of the explosive change then acts upon the actuating member and the downhole tool is actuated. Alternatively, smoke from the explosive charge that was activated by the heat from the battery or the electronic line may also act against the actuating member to actuate the downhole tool.

SUMMARY OF INVENTION

Broadly, the actuator devices for downhole tools have a housing or body, an actuating member, a retaining member, and a gas releasing material that is activated by a non-heat activator such as a fluid or solvent. Examples of retaining members include shear pins and chambers having equalized pressures. The retaining member prevents movement of the actuating member until the gas releasing material releases a gas and the pressure rises sufficiently to actuate the tool. In one specific embodiment, the gas is released by dissolution of the gas releasing material. Upon dissolution of the gas releasing material, gas is released and captured within a pressure chamber. As the gas pressure within the pressure chamber increases, due to the continued release of gas from the gas releasing material, the retaining member is no longer capable of preventing the movement of the actuating member. As a result, the actuating member moves and, thus, sets the downhole tool.

In certain specific embodiments, the gas pressure from the gas releasing material sets the downhole tool by one or more of freeing a piston to move or by any other mechanism known to persons skilled in the art. Moreover, in some embodiments, gas pressure sets the tool. Alternatively, the gas pressure from the gas releasing material sets the downhole tool may assist another setting mechanism, such as use of drilling fluid pressure or hydrostatic pressure, in setting the downhole tool.

The gas releasing material may be any material known to persons of ordinary skill in the art. Preferably, the gas releasing material is dissolved, disintegrated, or degraded to release the gas. In certain specific embodiments, solvents, such as water or hydrocarbon based drilling fluids or mud, can be used to dissolve the gas releasing material. Solvents include liquids, gases or other fluids, but do not include heat.

The actuator devices and methods disclosed herein not only permit actuation of the downhole tool, but actively assist in the actuation of the downhole tool through the release of a gas that provides a gas pressure. Thus, the gas pressure, either alone or in combination with any other actuation mechanism known to persons skilled in the art, plays an active role in actuation of the downhole tool.

In one aspect, one or more of the foregoing advantages may be achieved by the present actuator device for a downhole tool. The actuator device is capable of selectively actuating the downhole tool. The actuator device comprises a housing having a chamber; an actuating member operatively connected to the housing, the actuating member having a piston carried within the chamber, wherein movement of the actuating member relative to the housing causes a downhole tool to perform a specified function; a gas releasing material disposed in the chamber on one side of the piston; and a port leading to the chamber for selectively delivering an activator fluid to the chamber, wherein upon contact with the activator fluid, gas is released from the gas releasing material, which causes gas pressure to build up within the chamber sufficient to move the piston to cause the actuating member to actuate the downhole tool.

A further feature of the actuator device is that the actuator device may further comprise a restraining member mounted to the actuating member for preventing movement of the actuating member until the gas pressure reaches a selected level. Another feature of the actuator device is that the gas releasing material may comprise a metal that dissolves and releases hydrogen when contacted by water. An additional feature of the actuator device is that the gas releasing material in the chamber may be disposed above the piston for moving the piston downward relative to the housing when contacted by the activator fluid. Still another feature of the actuator device is that, prior to releasing the gas, the piston may have substantially equal pressures on its opposite sides. A further feature of the actuator device is that the port may extend to an exterior portion of the housing and the activator fluid is located in the wellbore. Another feature of the actuator device is that the actuator device may further comprise a rupture disk mounted in the port, which ruptures at a sufficient wellbore pressure to allow the activator fluid in the wellbore to enter the chamber. An additional feature of the actuator device is that the actuator device may further comprise a check valve in the port between the rupture disk and the chamber for allowing the activator fluid in the wellbore to enter the chamber after the rupture disk has ruptured but resisting flow of gas from the gas releasing material out the port to the wellbore. Still another feature of the actuator device is that the actuator device may further comprise a dissolvable membrane disposed in the port for blocking flow of the activator fluid in the wellbore to the chamber, the membrane dissolving after sufficient contact with the activator fluid in the wellbore.

In another aspect, one or more of the foregoing advantages may be achieved by the present actuator device comprising a housing; an actuating member operatively connected to the housing, wherein the movement of the actuating member causes a downhole tool to perform a specified function; a piston operatively associated with the actuating member, the piston being carried in a chamber in the housing, separating the chamber into a first chamber portion and a second chamber portion; a dissolvable gas releasing material disposed in the first chamber portion; a port extending through the housing from the first chamber to an exterior portion of the housing for admitting wellbore fluid to the first chamber; and a blocking member in the port for selectively delaying entry of wellbore fluid to the first chamber, wherein when the blocking member opens the port, wellbore fluid contacts and begins dissolving the gas releasing material, causing a gas to be released within the first chamber portion, creating a net differential force on the piston, which moves into the second chamber portion and causes the actuating member to actuate the downhole tool.

A further feature of the actuator device is that the gas releasing material may comprise a metal that dissolves and releases hydrogen when contacted by water. Another feature of the actuator device is that the blocking member may comprise a membrane that dissolves at a selected rate when immersed in wellbore fluid. An additional feature of the actuator device is that the first chamber portion may have a first chamber pressure and the second chamber portion may have a second chamber pressure, and the first pressure chamber pressure may be substantially equal to the second pressure chamber prior to the release of the gas from the gas releasing material. Still another feature of the actuator device is that the blocking member in the port may comprise a rupture disk that ruptures upon reaching a selected wellbore pressure. A further feature of the actuator device is that the blocking member may comprise a valve. Another feature of the actuator device is that actuator device may further comprise a one-way check valve in the port between the blocking member and the first chamber portion that allows wellbore fluid to flow into the first chamber portion but resists flow of gas from the first chamber portion to the wellbore.

In another aspect, one or more of the foregoing advantages may be achieved by the present improved actuator device for actuating a downhole tool having an actuating member. The improved actuator device comprises at least one gas releasing material operatively associated with a restraining member wherein activation of the gas releasing material by an activator fluid causes a gas to be released from the gas releasing material such that the restraining member no longer restrains movement of the actuating member such that the actuating member is capable of moving, causing actuation of the downhole tool.

In still another aspect, one or more of the foregoing advantages may be achieved through the present method of selectively actuating a downhole tool. The method comprises the steps of: (a) providing a downhole tool with a piston within a chamber having a gas releasing material located therein on one side of the piston; (b) lowering the tool into a wellbore and contacting the gas releasing material with an activator fluid capable of causing release of a gas from the gas releasing material; and (c) capturing the gas within the chamber and creating a pressure differential across the piston, causing the piston to move and actuate the downhole tool.

A further feature of the method is that step (b) may be performed by contacting the gas releasing material with a wellbore fluid. Another feature of the method is that step (b) may further comprise selectively delaying contact of the wellbore fluid with the gas releasing material.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
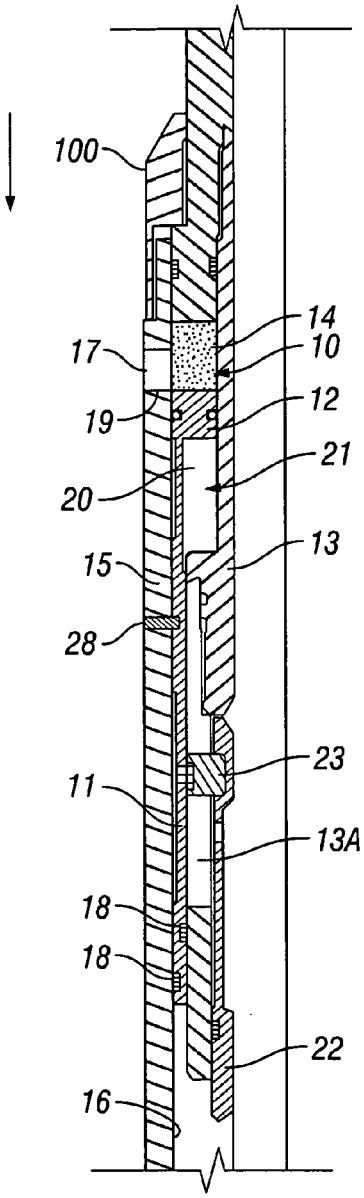
FIG. 1 is a cross-sectional view of one specific embodiment of the actuator device of the present invention shown in its initial or run-in position
Figure 2:
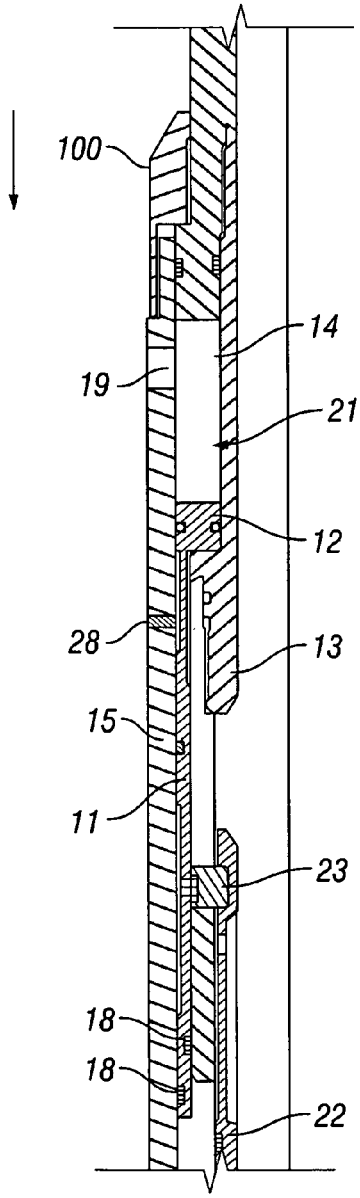
FIG. 2 is a cross-sectional view of the actuator device shown in FIG. 1 in its actuated position.

Referring now to FIGS. 1-4, in one embodiment, actuator device 10 is included as part of downhole tool 100. Downhole tool 100 is lowered on a string of conduit into the well and may be used for setting a packer, a bridge plug, or various other functions. Actuator device 10 has an actuating member, which as shown in FIGS. 1-2, is piston 12. Generally, movement of piston 12 sets downhole tool after it is properly located in a well (not shown). As shown in FIG. 1, piston 12 is in its initial or "run-in" position. The initial position is the position prior to actuation of downhole tool 100. FIG. 2 shows piston 12 in the actuated position.

In this example, piston 12 includes a depending sleeve 11 carried in an annular chamber around a central mandrel assembly 13 of tool 100 and within a housing 15 of tool 100. Sleeve 11 has inner and outer seals 18 that slidably engage mandrel assembly 13 and the inner side wall of housing 16 when actuated. Sleeve 11 of piston 12 is connected to an actuating member 22 by key 23 extending through an elongated slot 13*a* in mandrel assembly 13 to move actuating member 22 downward when piston 12 moves downward. Actuating member 22 performs a desired function, such as setting a packer. When actuated, a force is applied to piston 12 in the direction of the arrow. As disclosed herein, the force is created, at least in part, by the build-up of gas pressure within upper chamber 14 from the gas being released from gas releasing material 60 contained within upper chamber 14. Additionally, the force can come from a variety of other sources operating in combination with the gas pressure. These other sources include hydrostatic pressure, fluid pressure pumped from the surface, or various springs or other energy storage devices or equivalents. When applied, the force moves piston 12 and sleeve 11 in the direction of the arrow.

Actuator device 10 also includes chamber 21. Chamber 21 has a lower chamber 20 and an upper chamber 14. The lower chamber 20 is located on the opposite side of piston 12 from upper chamber 14. In one embodiment, the pressure within upper chamber 14 and lower chamber 20 maintain, or retain, piston 12 in the run-in position until the gas is released from the gas releasing material contained within upper chamber 14. In a preferred embodiment, the pressure within upper chamber 14 is equalized with the pressure in lower chamber 20 during run-in. Actuator device 10 would normally be connected to a device (not shown) being set, such as a packer, which would provide resistance to movement of piston 12 during run-in. Optionally, a shear pin 28 maintains, or retains, piston 12 in the run-in position until the gas is released from the gas releasing material contained within upper chamber 14. Shear pin 28 is secured between sleeve 11 and housing 15. If shear pin 28 is employed, the pressures in upper chamber 14 and lower chamber 20 could initially differ during run-in.

At least a portion of upper chamber 14 is filled with the gas releasing material 60. In the specific embodiment shown in FIG. 1, the entire volume of upper chamber 14 is filled with the gas releasing material. The term "gas releasing material" as used herein means that the material is capable of releasing a gas, such as hydrogen, carbon dioxide, carbon monoxide, or steam, when contacted with an activator fluid such as water or hydrocarbons. In a preferred embodiment, the gas releasing material is dissolvable.

The term "dissolvable" as used herein means that the material is capable of dissolution in a solvent disposed within the well, such as in tubing, casing, the string, or the downhole tool. The term "dissolvable" is understood to encompass the terms degradable and disintegrable. Likewise, the terms "dissolved" and "dissolution" also are interpreted to include "degraded" and "disintegrated," and "degradation" and "disintegration," respectively.

The gas releasing material may be any material known to persons of ordinary skill in the art that is capable of releasing a gas. In the embodiments in which the gas releasing material releases a gas upon dissolution, the gas releasing material may be any material known to persons of ordinary skill in the art that can be dissolved, degraded, or disintegrated to release the gas over an amount of time by a fluid such as water-based drilling fluids, hydrocarbon-based drilling fluids, or natural gas. In a preferred embodiment, the gas releasing material is TAFA Series 300-301 Dissolvable Metal from TAFA Incorporated of Concord, N.H. This material releases hydrogen gas when contact with water. For example, 100 grams of TAFA Series 300-301 Dissolvable Metal placed in contact with 8.3 liters of water within a chamber of having the same volume, releases enough hydrogen gas to create more than 1,500 psi.

In certain embodiments, water or some other chemical could be used alone or in combination with time and/or well temperature to dissolve the dissolvable material. Other fluids that may be used to dissolve the dissolvable material include alcohols, mutual solvents, and fuel oils such as diesel.

It is to be understood that the apparatuses and methods disclosed herein are considered successful if the gas releasing material releases sufficient gas such that the actuating member, e.g., piston, is moved from its initial or "run-in" position to its actuated or "setting" position so that the downhole tool is set. In other words, the apparatuses and methods are effective even if all of the gas from the gas releasing material does not dissolve. In one specific embodiment, at least 50% of the gas contained in the gas releasing material is released. In other specific embodiment, at least 90% of the gas contained in the gas releasing material is released.

It is also to be understood that the gas pressure from the gas releasing material may assist another setting mechanism, such as use of drilling fluid pressure or hydrostatic pressure, in setting the downhole tool. Accordingly, as long as the downhole tool is set through the assistance, either alone or in conjunction with another setting mechanism, the apparatuses and methods disclosed herein are considered successful.

Still with reference to FIG. 1, actuator device 10 also includes rupture disk 17 that is designed to break-away at predetermined depths due to hydrostatic pressure of the well fluid or fluid pressures applied by pumps at the surface of the well. Rupture disks 17 are known in the art. Passageway 19 contains rupture disc 17 and is in fluid communication with upper chamber 14.

Although passageway 19 is shown horizontally disposed within housing 15, passageway 19 may be disposed at an angle such that the intersection of passageway 19 with the wellbore environment is lower than the intersection of passageway 19 with upper chamber 14. Therefore, gas being released by the gas releasing material within upper chamber 14 would have to flow downward to escape through passageway 19 into the environment. Thus, it is more difficult for the gas to escape upper chamber 14.

Figure 3:
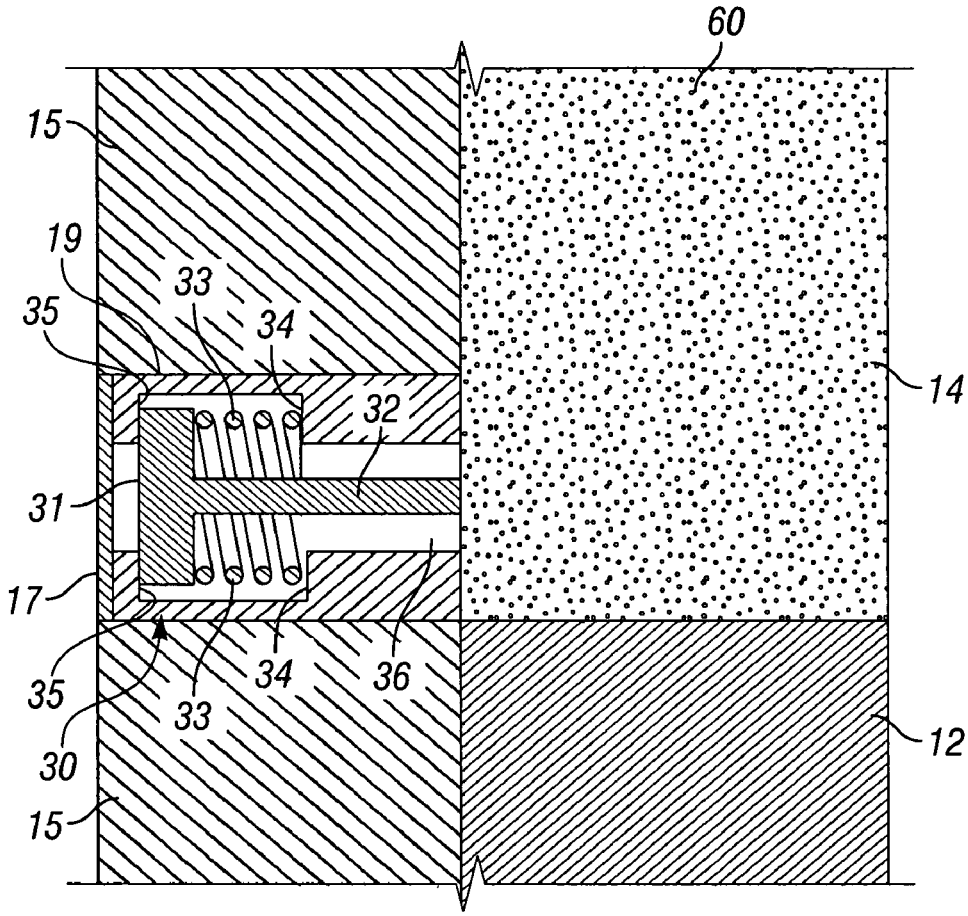
FIG. 3 is a cross-sectional view of an additional specific embodiment of the actuator device of the present invention.

As illustrated in detail in FIG. 3, passageway 19 may include one-way check valve 30 to permit wellbore fluid to enter passageway and, thus chamber 14 and to prevent the gas being released by the gas releasing material 60 within upper chamber 14 from escaping into the wellbore environment. Check valve 30 includes head 31 and stem 32 that extends through a check-valve passage 36. Head 31 moves between upper and lower positions and seals against seat 35 while in the upper position (shown in FIG. 3). Check valve 30 also includes coil spring 33 and spring retainer 34 so that coil spring 33 urges head 31 outward against seat 35. In its initial position (shown in FIG. 3) prior to the rupture of rupture disc 17, head 31 engages seat 35 and blocks or prevents fluid from flowing from upper chamber 14 through passageway 19.

After rupture disc 17 is ruptured, wellbore fluid presses against head 31 urging head 31 inward against coiled spring 33, causing coiled spring 33 to be compressed between head 31 and spring retainer 34. As a result, wellbore fluid is permitted to flow around head 31, through check-valve passage 36, and into contact with the gas releasing material 60 contained within upper chamber 14. Gas is then released from gas releasing material 60 and is captured within upper chamber 14 because the gas pressure initially is not high enough to overcome the wellbore fluid pressure. When the gas pressure becomes high enough to overcome the wellbore fluid pressure, the gas pressure acts on head 31 of check valve 30 and urges, with the assistance of coiled spring 33, head 31 outward until against seat 35. Therefore, gas is not permitted to escape from upper chamber 14. Moreover, in a preferred embodiment, any gas remaining within gas releasing material 60 continues to be released from the gas releasing material after check valve 30 closes to prevent additional wellbore fluid from entering upper chamber 14. Therefore, even after wellbore fluid is blocked from entering upper chamber 14, the gas pressure of the gas being released from the gas releasing material continues to increase to actuate piston 12.

Figure 4:
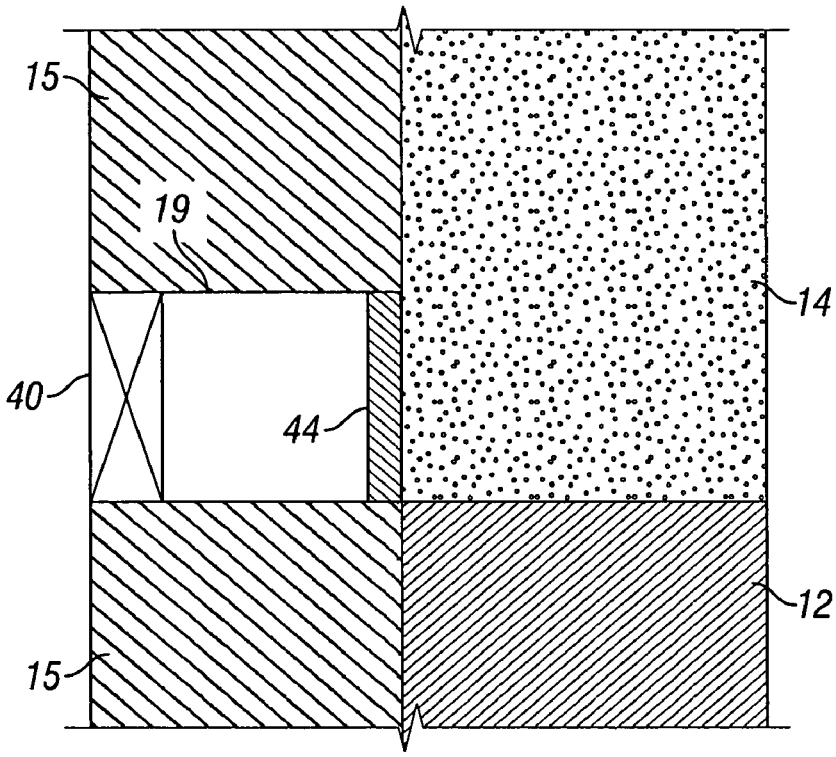
FIG. 4 is a cross-sectional view of still another specific embodiment of the actuator device of the present invention.

In another embodiment, shown in FIG. 4, an actuatable valve 40 placed within passageway 19 may be opened to let water or other solvent from the wellbore into passageway 19. Actuatable valve 40 may then be closed. Valve 40 is shown schematically, and it could be operated remotely in a variety of manners. For example, valve 40 may be a sleeve valve or a ball valve that is opened and closed hydraulically or through any other method known to persons skilled in the art. When valve 40 is open, solvent or water within passageway 19 then dissolves dissolvable membrane 44 that separates passageway 19 from upper chamber 14. After the dissolvable membrane is dissolved, the solvent or water then contacts the gas releasing material to dissolve the gas releasing material and release the gas.

Suitable dissolvable membranes may be formed from polymers and biodegradable polymers, for example, polyvinyl-alcohol based polymers such as the polymer HYDROCENE™ available from Idroplax, S.r.l. located in Altopascia, Italy, polylactide ("PLA") polymer 4060D from Nature-Works™, a division of Cargill Dow LLC; TLF-6267 polyglycolic acid ("PGA") from DuPont Specialty Chemicals; polycaprolactams and mixtures of PLA and PGA; solid acids, such as sulfamic acid, trichloroacetic acid, and citric acid, held together with a wax or other suitable binder material; polyethylene homopolymers and paraffin waxes; polyalkylene oxides, such as polyethylene oxides, and polyalkylene glycols, such as polyethylene glycols. These polymers may be preferred in water-based drilling fluids because they are slowly soluble in water.

Figure 5:
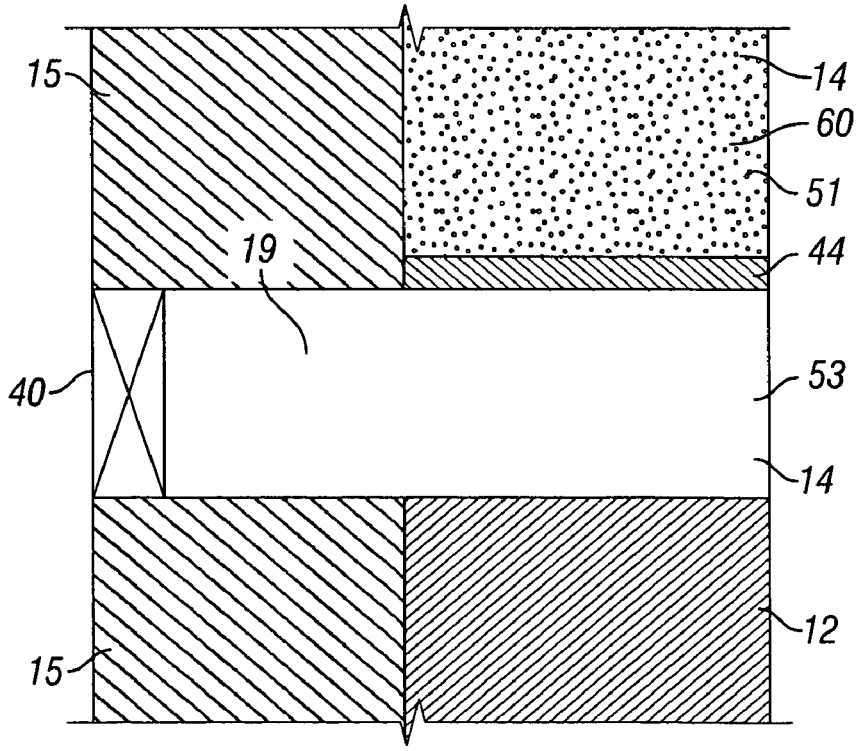
FIG. 5 is a cross-sectional view of yet another specific embodiment of the actuator device of the present invention.

Referring now to FIG. 5, in another embodiment, dissolvable membrane 44 is within upper chamber 14, thereby dividing upper chamber 14 into upper portion 51 and lower portion 53. Gas releasing material 60 is disposed within upper portion 51, but not in lower portion 53. In this embodiment, actuatable valve 40 is opened to permit hydrostatic pressure and wellbore fluid to enter passageway 19. Hydrostatic pressure then acts on piston 12; however, in this embodiment, the hydrostatic pressure is not sufficient to fully actuate the downhole tool without additional assistance from another actuator device. In these circumstances, actuatable valve 40 can be closed and the wellbore fluid can dissolve the dissolvable membrane 44. After dissolution of the dissolvable membrane 44, the wellbore fluid can activate gas releasing material 60 to release the gas. The pressure increase caused by the release of gas from gas releasing material 60 then assists the hydrostatic pressure to fully actuate the downhole tool.

Moreover, in certain embodiments, dissolvable membrane 44 is not required. For example, actuatable valve 40 may be opened for a period of time to permit the wellbore fluid to begin releasing the gas from the gas releasing material 60. However, before the gas pressure reaches a level where it overcomes the wellbore fluid pressure, the valve is closed. In this embodiment, a certain amount of gas can be released before the gas releasing material is isolated from the wellbore environment.

In operation, downhole tool 100 is lowered into a well (not shown) containing a well fluid by a string (not shown) of conduit that would be attached to mandrel assembly 13. In one technique, during the running-in, the portion of piston 12 above seals 18 and retaining member 14 are isolated from wellbore fluid, and actuating member 22 and the portion of piston 12 below seals 18 are also isolated from wellbore fluid. The pressure on the upper and lower sides of piston seals 18 would be at atmospheric. Likewise, the pressure in upper chamber 14 and lower chamber 20 is also atmospheric.

The pressure difference on the exterior and interior sides of rupture disk 17 would be the difference between the hydrostatic pressure of the well fluid and atmospheric. Upon reaching a certain depth or a certain hydrostatic pressure of well fluid, rupture disk 17 breaks away placing passageway 19 and upper chamber 14 in contact with the wellbore environment. Fluid from the wellbore such as water, drilling fluid, or some other solvent capable of dissolving the gas releasing material within chamber 14 then contacts the gas releasing material 60. As the gas releasing material dissolves, gas is released into upper chamber 14, causing the pressure within upper chamber 14 to increase and exert a downward force on piston 12 because the pressure in lower chamber 20, as well as below seals 18, i.e., is atmospheric. As a result, piston 12 moves downward and actuates downhole tool 100 by moving actuating member 22 downward to the position shown in FIG. 2. If shear pin 28 is employed, the pressure build-up in upper chamber 14 would be sufficient to cause it to shear.

It is to be understood that the invention is not limited to the exact details of construction, operation, exact materials, or embodiments shown and described, as modifications and equivalents will be apparent to one skilled in the art. For example, the pressure in the lower chamber and, thus, below the seals, may be initially higher than the pressure in the upper chamber so that the piston is urged upward to maintain the downhole tool in its "run-in" position. As is apparent, in such an embodiment, the gas pressure in the upper chamber as a result of the gas being released from the gas releasing material must be higher to overcome the pressure in the lower chamber and the area below the seals before the tool can be actuated. Accordingly, the invention is therefore to be limited only by the scope of the appended claims.

What is claimed is:

1. An actuator device for a downhole tool, the actuator device capable of selectively actuating the downhole tool, the actuator device comprising:

a housing having a chamber;

an actuating member operatively connected to the housing, the actuating member having a piston carried within the chamber, wherein movement of the actuating member relative to the housing causes the downhole tool to perform a specified function;

a gas releasing material disposed in the chamber on one side of the piston; and a port leading to the chamber for selectively delivering an activator fluid to the chamber, wherein the port extends to an exterior portion of the housing and the activator fluid is located in a wellbore, and wherein upon contact with the activator fluid, gas is released from the gas releasing material, which causes gas pressure to build up within the chamber sufficient to move the piston to cause the actuating member to actuate the downhole tool.

2. The actuator device of claim 1, further comprising a restraining member mounted to the actuating member for preventing movement of the actuating member until the gas pressure reaches a selected level.

3. The actuator device of claim 1, wherein the gas releasing material comprises a metal that dissolves and releases hydrogen when contacted by water.

4. The actuator device of claim 1, wherein the gas releasing material in the chamber is disposed above the piston for moving the piston downward relative to the housing when contacted by the activator fluid.

5. The actuator device of claim 1, wherein prior to releasing the gas, the piston has substantially equal pressures on its opposite sides.

6. The actuator device of claim 1, further comprising a rupture disk mounted in the port, which ruptures at a sufficient wellbore pressure to allow the activator fluid in the wellbore to enter the chamber.

7. The actuator device of claim 6, further comprising a check valve in the port between the rupture disk and the chamber for allowing the activator fluid in the wellbore to enter the chamber after the rupture disk has ruptured but resisting flow of the gas from the gas releasing material out the port to the wellbore.

8. The actuator device of claim 1, further comprising a dissolvable membrane disposed in the port for blocking flow of the activator fluid in the wellbore to the chamber, the membrane dissolving after sufficient contact with the activator fluid in the wellbore.

9. An actuator device for a downhole tool, the actuator device capable of selectively actuating the downhole tool, the actuator device comprising:

a housing;

an actuating member operatively connected to the housing, wherein the movement of the actuating member causes a downhole tool to perform a specified function;

a piston operatively associated with the actuating member, the piston being carried in a chamber in the housing, separating the chamber into a first chamber portion and a second chamber portion;

a dissolvable gas releasing material disposed in the first chamber portion;

a port extending through the housing from the first chamber to an exterior portion of the housing for admitting wellbore fluid to the first chamber; and a blocking member in the port for selectively delaying entry of the wellbore fluid to the first chamber, wherein when the blocking member opens the port, the wellbore fluid contacts and begins dissolving the gas releasing material, causing a gas to be released within the first chamber portion, creating a net differential force on the piston, which moves into the second chamber portion and causes the actuating member to actuate the downhole tool.

10. The actuator device of claim 9, wherein the gas releasing material comprises a metal that dissolves and releases hydrogen when contacted by water.

11. The actuator device of claim 9, wherein the blocking member comprises a membrane that dissolves at a selected rate when immersed in wellbore fluid.

12. The actuator device of claim 9, wherein the first chamber portion has a first chamber pressure and the second chamber portion has a second chamber pressure, and the first pressure chamber pressure is substantially equal to the second pressure chamber prior to the release of the gas from the gas releasing material.

13. The actuator device of claim 9, wherein the blocking member in the port comprises a rupture disk that ruptures upon reaching a selected wellbore pressure.

14. The actuator device of claim 9, wherein the blocking member comprises a valve.

15. The actuator device of claim 9, wherein the further comprising a one-way check valve in the port between the blocking member and the first chamber portion that allows wellbore fluid to flow into the first chamber portion but resists flow of the gas from the first chamber portion to the wellbore.

16. An improved actuator device for actuating a downhole tool having an actuating member, the improvement comprising:

at least one gas releasing material in fluid communication with a port, the port being in fluid communication with a wellbore fluid exterior to the housing, and the at least one gas releasing material being operatively associated with a restraining member wherein activation of the gas releasing material by the wellbore fluid flowing through the port causes a gas to be released from the gas releasing material such that the restraining member no longer restrains movement of the actuating member such that the actuating member is capable of moving, causing actuation of the downhole tool.

17. A method of selectively actuating a downhole tool, the method comprising the steps of:

(a) providing a downhole tool with a piston within a chamber having a gas releasing material located therein on one side of the piston, the gas releasing material being in fluid communication with a port extending to an exterior portion of the downhole tool;

(b) lowering the tool into a wellbore and contacting the gas releasing material with a wellbore fluid flowing through the port, the wellbore fluid being capable of causing release of a gas from the gas releasing material; and (c) capturing the gas within the chamber and creating a pressure differential across the piston, causing the piston to move and actuate the downhole tool.

18. The method of claim 17, wherein step (b) further comprises selectively delaying contact of the wellbore fluid with the gas releasing material.

* * * * *

UNITED STATES PATENT AND TRADEMARK OFFICE

CERTIFICATE OF CORRECTION

PATENT NO. : 7,591,319 B2
APPLICATION NO. : 11/522693
DATED : September 22, 2009
INVENTOR(S) : Yang Xu It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 314 days.

Signed and Sealed this

Fourteenth Day of December, 2010

David J. Kappos

David J. Kappos
*Director of the United States Patent and Trademark Office*